United States Patent [19]

Kerr et al.

[11] Patent Number: 4,527,497

[45] Date of Patent: Jul. 9, 1985

[54] DIFFERENTIAL FEED SYSTEM WITH SAFETY DEVICE

[75] Inventors: Alexander F. Kerr, Hazlet, N.J.; Hiroshi Kiyoshima, Utsunomiya, Japan

[73] Assignee: The Singer Company, Stamford, Conn.

[21] Appl. No.: 453,313

[22] Filed: Dec. 27, 1982

[51] Int. Cl.[3] ..... D05B 27/08

[52] U.S. Cl. ..... 112/313

[58] Field of Search ..... 112/312, 313

[56] References Cited

U.S. PATENT DOCUMENTS

| | | | |
|---|---|---|---|
| 3,160,127 | 12/1964 | Orth et al. . | |
| 3,202,121 | 8/1965 | Orth et al. . | |
| 3,611,817 | 10/1971 | Smith et al. . | |
| 3,967,565 | 7/1976 | Kirayama et al. . | |
| 4,027,609 | 6/1977 | Kerr | 112/313 |
| 4,244,314 | 1/1981 | Onembo | 112/313 |
| 4,436,045 | 3/1984 | Bonham et al. | 112/313 |

FOREIGN PATENT DOCUMENTS

| | | |
|---|---|---|
| 1091842 | 4/1959 | Fed. Rep. of Germany . |
| 586449 | 12/1963 | Japan . |
| 57-17019 | 5/1972 | Japan . |
| 1130343 | 11/1965 | United Kingdom . |

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A differential feed system in which a main feed bar supports an auxiliary feed bar for rising and falling motion but for independent longitudinal motion and wherein longitudinal motion of the auxiliary feed bar is derived from oscillations imparted to a differential feed shaft from a main feed shaft. A safety mechanism is provided in which a safety bar is pivotably connected to a feed regulator control for the main feed and is fashioned with a lost motion connection to a feed control for the auxiliary feed. Motion of the lever for auxiliary feed control is possible in a limited range determined by the degree of lost motion in the safety bar and motion of this lever beyond the limited range will shift the regulator for the main feed system in the same increasing or decreasing feed direction as the lever for the auxiliary system is being shifted.

4 Claims, 3 Drawing Figures

DIFFERENTIAL FEED SYSTEM WITH SAFETY DEVICE

BACKGROUND OF THE INVENTION

This invention is concerned with sewing machines; more particularly, it is concerned with a differential feed system for use in an overedge sewing machine and having a safety device to prevent the setting of a differential feed, which would cause interference of parts of the sewing machine.

In a differential feed system, a rear or main feed dog is provided for feeding the work material through the sewing machine, and a front feed dog is utilized to gather the work material as it passes beneath the sewing needle or to stretch the work material, depending upon the work material utilized and the intentions of the sewing machine operator. It is usual in a differential feed system to provide for separate stitch length regulators for the front feed dog and the rear feed dog. Where the front feed dog movement exceeds that of the rear feed dog, material gathering takes place which may have an ornamental effect, such as shirred sleeves of a garment, for example. If the fabric is closely woven and soft in nature, it will require "stretch" in which the rear feed dog feeds faster than the forward feed dog, so that the article will maintain a natural appearance. Generally, in order to obtain the "gather" or the "stretch", the range of motion of the front feed dog is regulated. Thus, a wide range of motions are possible for the front feed dog, including motions which might interfere with other parts of the sewing machine, or the frame thereof.

What is required is a differential feed system having the independent selectability of the feed for the rear feed dog and for the forward feed dog and the capability to avoid the possible interference of parts.

SUMMARY OF THE INVENTION

This requirement has been met in a differential feed system in which a main feed bar slidingly supports an auxiliary feed bar so as to impart lift thereto while permitting separate feeding motion of the main feed bar and the auxiliary feed bar. The main feed bar is fashioned with a fork having a slide block therein which encircles an eccentric cam affixed to a main shaft driven by a sewing machine motor. Rotation of the eccentric cam applies lift to the main feed bar and, by virtue of the connection of the main feed bar to the auxiliary feed bar, also to the auxiliary feed bar. The main feed bar is connected, at one end thereof, to one arm of a three armed feed shaft having a second arm connected to a feed adjusting link caused to undergo oscillating motion by means of a second eccentric feed cam connected to the center of the feed adjusting link by a connecting rod. The end of the feed adjusting link opposite the feed shaft is connected to a slide block sliding in a groove of a feed regulator. By canting of the slide block, the feed adjusting link undergoes longitudinal motion which is imparted to the feed shaft in the form of oscillations, which oscillations move the main feed bar back and forth. The third arm of the feed shaft is connected by a link to a radial slot on a member carried one one end of a differential feed shaft. The oscillation of the feed shaft imparted to the arm oscillates the differential feed shaft and a crank affixed to the other end of the differential feed shaft and fashioned with a pin extending into a vertical groove in the auxiliary feed bar in order to induce independent sliding motion of the auxiliary feed bar without affecting vertical motion thereof. The position of the link in the slot of the radially slotted member affixed to the differential feed shaft, is adjusted by one end of a second link having the other end connected to a mechanical positioning mechanism which terminates at one end of a centrally pivoted lever in a screw extending through a slot in a guide, so that the selected position thereof may be clamped by means of a nut fashioned as a knob. In order to prevent adjustment of the auxiliary feed system relative to the primary feed regulator beyond that point at which interference would take place between the various parts of the feed system and other parts or frame of the sewing machine, a safety bar is slotted at one end for slidable connection to the centrally pivoted lever adjacent the adjusting knob thereof, and has the other end pivoted on the primary feed regulator so that adjustment of the auxiliary feed regulator beyond the point of safe operation thereof will bring about an adjustment of the primary feed regulator to that point where operation of the sewing machine bring about no interference of parts.

DESCRIPTION OF THE DRAWINGS

Although the specification concludes with claims particularly pointing out and distinctly claiming the subject matter regarded as forming the present invention, it is believed that the invention will be better understood, and objects and important features other than those specifically enumerated above will become apparent from the hereinafter set forth detailed description of the invention taken in conjunction with the annexed drawings wherein like reference characters are used for the parts throughout the several views and, in which:

DETAILED DESCRIPTION OF THE INVENTION

Figure 1:
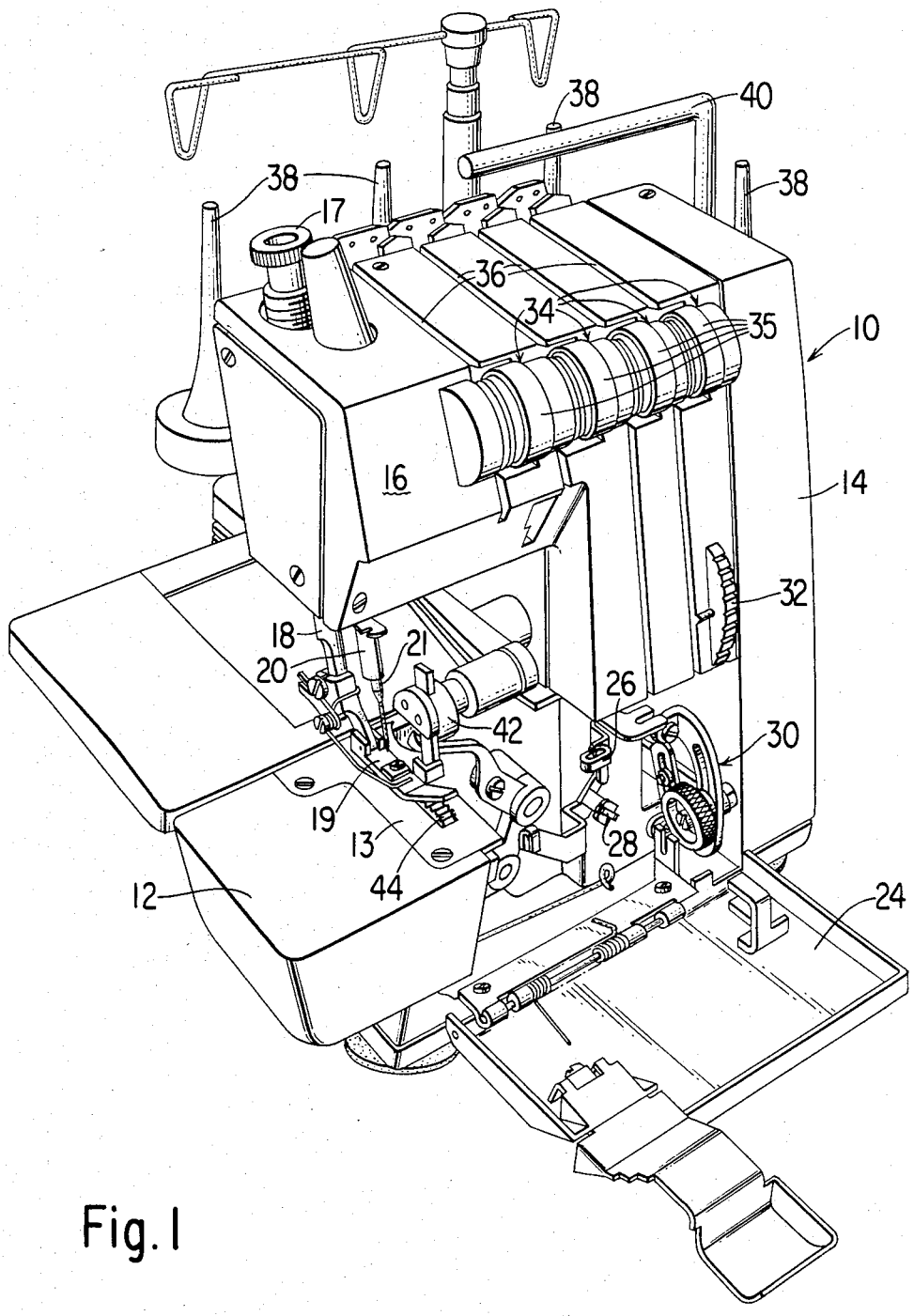
FIG. 1 is a perspective illustration of a sewing machine in which the invention may be incorporated.

Referring to FIG. 1, there is shown an overedge sewing machine 10 in which the invention might be incorporated. The sewing machine 10 includes a bed 12 supporting therein a throat plate 13. On one end of the bed, a standard 14 rises to support a bracket arm 16 overhanging the bed, within which bracket arm there is supported in the usual fashion a presser bar 18 terminating in a presser foot 19 and needle bar 20 supporting a needle (or needles) 21 in the end thereof for reciprocation through the throat plate 13 in the formation of stitches. The bed 12 supports therein a cover plate 24, shown in the swung away position to expose an internal control 30 and thread guides 26, 28.

Supported in the standard 14 is an external control dial 32. The bracket arm 16 supports therein, in the embodiment shown, four thread tension devices 34 which are adjustable by means of knobs 35. Race ways 36 provide passageway for thread extending from spools (not shown) supported on spool pin holders 38 attached to the rear of the sewing machine frame. Presser pressure adjustment may be made by means of knob 17, and carrying handle 40 is attached to the sewing machine standard 14 and extends over the bracket arm 16. A trimming attachment 42 is shown supported by the bed 12 for the purpose of trimming fabric before stitching thereof by the sewing needle 21.

Figure 2:
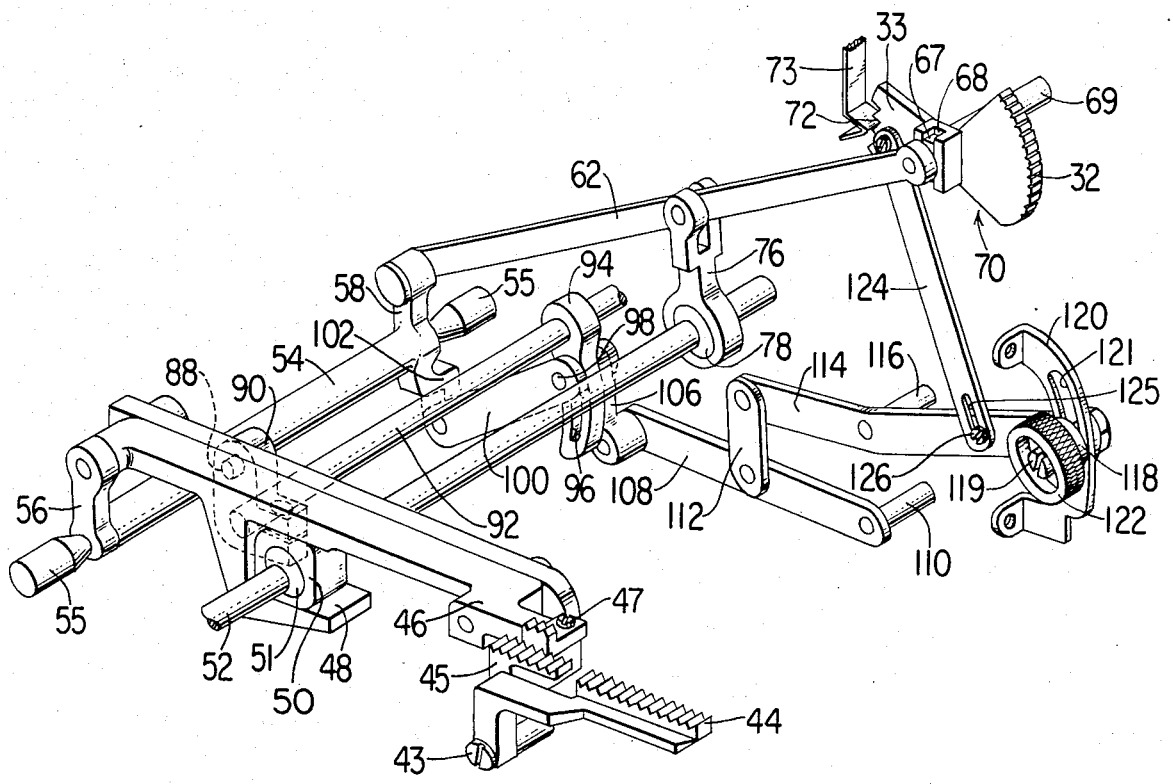
FIG. 2 is a perspective illustration of the feed system incorporated in the sewing machine shown in FIG. 1; and, FIG. 3 is a perspective illustration of the main feed bar and auxiliary feed bar shown in FIG. 2 from another angle.

Referring now to FIG. 2, there is shown the feeding system supported within the bed 12 including the front feed dog 44 which is visible extending through the throat plate 13 in FIG. 1. In FIG. 2, rear feed dog 45 is attached to the main feed bar 46 by a screw 47. The main feed bar 46 extends rearwardly in the sewing machine bed 12 in the direction of the feed. Approximately centrally of its length, the main feed bar 46 is fashioned with a fork 48, which fork slidingly accommodates a slide block 50 which is fitted with an eccentric cam 51 carried by and rotating with a main drive shaft 52 for the sewing machine 10. The end of the main feed bar 46 opposite the rear feed dog 45 is pivotably carried by a first arm 56 of a feed shaft 54 pivotably accommodated in the sewing machine on, for example, bullet centers 55. A second arm 58 extends from the feed shaft 54 and is pivotably connected to one end of a feed adjusting link 62, the other end of which is pivotably connected to a slide block 67 carried in a slideway 68 which is pivotably carried by a frame supported shaft 69 for rotation of the slideway by the external control dial 32. The slide block 67, slideway 68, shaft 69 and dial 32 comprise the main feed regulator 70. The external control dial 32 is fashioned with an internal portion 33 which is formed with detent teeth 72, which teeth cooperate with spring 73 to define discrete positions for the external control dial.

Pivotably affixed to the feed adjusting link 62 approximately centrally thereof is a cam rod 76, the other end of which encircles a second eccentric cam 78 also mounted on, and rotatable with, the main shaft 52. Thus, as the feed adjusting link 62 oscillates about its pivotable connection with the second arm 58 of the feed shaft 54, under the urgings of the second eccentric cam 78, the feed adjusting link undergoes translation in accordance with the angle of inclination of the slideway 68 as determined by the position of the external control dial 32. The translatory motion of the feed adjusting link 62 causes an oscillating motion of the feed shaft 54 which, in turn, creates a feeding and return motion of the main feed bar 46. The eccentric cam 51 operates in synchronism with the oscillations of the feed shaft 54 so as to lift the main feed bar 46, and the rear feed dog 45, which is attached to the main feed bar, moves in a feeding motion implemented by oscillation of the feed shaft 54. When the eccentric cam 51 lowers the main feed bar 46, the rear feed dog 45 drops beneath the throat plate 13 and moves in a return motion to the starting feed position.

Figure 3:
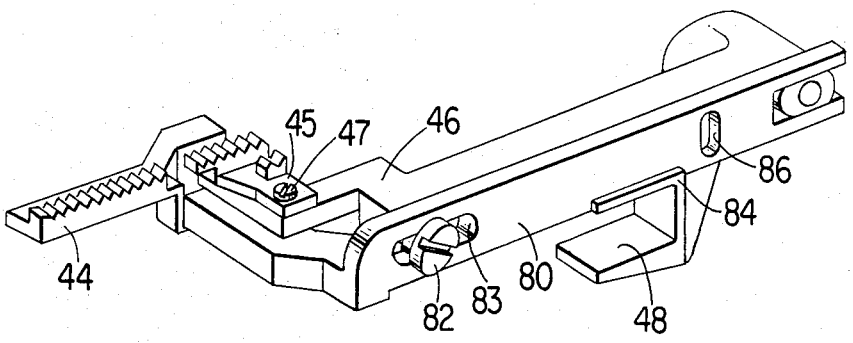

The front feed dog 44 is attached by screw 43 to auxiliary feed bar 80 (see also FIG. 3). The auxiliary feed bar 80 is connected to the main feed bar 46 by a shouldered screw 82 extending through slot 83 in the auxiliary feed bar 80 into the main feed bar. The auxiliary feed bar 80 is also carried on an extension 84 to fork 48 of the main feed bar 46 which extension extends about the auxiliary feed bar and retains the same clasped to the main feed bar. Thus, the auxiliary feed bar 80 partakes of vertical motion with the main feed bar 46, but is capable of separate horizontal motion with respect thereto. The auxiliary feed bar is fashioned with a vertical slot 86 (see FIG. 3). A pin 88 is received in the vertical slot 86, which pin is carried in the end of a crank 90 having the other end affixed to a differential feed shaft 92. The differential feed shaft 92 also has affixed thereto one end of a member 94, which member is fashioned with a curved slot 96 extending substantially radially to the differential feed shaft. The curved slot 96 of the member 94 accommodates therein pin 98 pivotally accommodating on one side of the curved slot 96 one end of a link 100. The other end of the link 100 is pivotably accommodated in the end of a third arm 102 of the feed shaft 54. Thus, any oscillation of the feed shaft 54 is passed on to the differential feed shaft 92 in a degree depending upon the position of the pin 98 in the curved slot 96 of the arm 94 affixed to the differential feed shaft.

The pin 98 extends through the curved slot 96 of the member 94 and is pivotably accommodated in one end of a connecting rod 106. The other end of the connecting rod 106 is pivotably connected to one end of a lever 108, the other end of which is carried by a pivot pin 110 pivotably secured in the sewing machine frame. Approximately midway the lever 108, a link 112 has one end pivotably connected thereto, the other end of the link being pivotably connected to a centrally pivoted lever 114. The centrally pivoted lever 114 is fashioned with a pivot stud 116 affixed to the central portion thereof, the pivot stud being accommodated by the sewing machine frame for permitting pivotable motion of the centrally pivoted lever 114. The end of 118 of the centrally pivoted lever 114 extends externally of the sewing machine bed 12 behind the cover plate 24. A stud 119 is affixed to the end 118 of the centrally pivoted lever 114, the stud extending through a slot 121 of a slotted guide bracket 120 affixed to the sewing machine frame. A knob 122 is threadedly received on the stud attached to the end 118 of the centrally pivoted lever 114 to affix the centrally pivoted lever with the stud extending through the slot 121 of the guide bracket 120 in a selected position. Rotating the centrally pivoted lever 114 to a position with the end 118 thereof adjacent the bottom end of the slot 121 in the guide bracket 120, will elevate by means of link 112, lever 108 and connecting rod 106, the pin 98 and thereby the end of the link 100 to the position shown in FIG. 2 in which the oscillation of the feed shaft 54 cause the maximum oscillation of the differential feed shaft 92. In this event, the front feed dog 44 will feed substantially more than the rear feed dog 45 so as to obtain a gathering of the work material being fed by the feed dogs beneath the sewing needle 21 of the sewing machine 10. Conversely, if the end 118 of the centrally pivoted lever 114 is located adjacent the upper extremity of the slot 122 in the bracket guide 120, the pin 98 will be located in the extremity of the curved slot 96 furthest from the differential feed shaft 92. In this event, the oscillation of the feed shaft will have the least effect and generate only small oscillations of the differential feed shaft 92 therby causing the front feed dog 44 to feed a lesser amount of material then is fed by the rear feed dog 45, creating a stretch in the work material.

In order to avoid such a differential between the main feed and the auxiliary feed which might cause an interference between the various components of the feed systems or between the components of the feed systems and the sewing machine frame, a safety bar 124 is provided having one end pivotably attached to the rear extension 33 to the external control 32, and the other end slotted as at 125 to be received on the shoulder, of a shouldered pin 126 attached to the centrally pivoted lever 114. Thus, with the primary feed regulating control 32 rotated to a maximum stitch length position, an attempt to position the knob 122 attached to the end 118 of the centrally pivoted lever 114 to the position shown in FIG. 2 will bring about a rotation of the external contral dial 32 to that position determined to be safe to avoid any interference between the components of the feed systems or with the sewing machine frame.

I claim:

1. A differential feed system for feeding a work material in a longitudinal direction in a sewing machine having a frame, said feed system comprising:

a main feed bar extending in said sewing machine frame in said longitudinal direction, said main feed bar being formed with a fork substantially midway thereof;

a first feed dog supported at one end of said main feed bar;

a feed shaft extending laterally of said main feed bar adjacent the other end thereof, said feed shaft having a first arm extending therefrom substantially normal to said main feed bar and pivotally connected to said other end of said main feed bar, said feed shaft having a second arm and a third arm extending therefrom;

a main shaft extending substantially parallel to said feed shaft and through said fork of said main feed bar;

a first cam supported for rotation with said main shaft and situated in said fork of said main feed bar for urging said first feed dog thereon in rising and falling motion;

a feed adjusting link having one end pivotably attached to said second arm of said feed shaft and extending in a longitudinal direction in said sewing machine frame beyond said main shaft to adjacent an external surface of said frame;

a second cam supported for rotation with said main shaft;

means for connecting said second cam with said feed adjusting link for imparting oscillating motion thereto;

a feed regulator connected to the other end of said feed adjusting link for converting a selectable degree of the oscillating motion thereof to longitudinal motion creating a oscillating motion of said feed shaft operating in synchronism with said first cam on said main shaft to provide a feed and return motion to said main feed bar in alternate synchronism with said rising and falling motion thereof;

a dial having a portion protruding exteriorly of said sewing machine frame for selective manipulation by an operator and connected to said feed regulator for adjustment of the same;

a differential feed shaft supported by said sewing machine frame parallel to said feed shaft and spaced therefrom;

a member connected to said differential feed shaft, said member having a slot therein extending substantially radially to the differential feed shaft;

a link having one end pivotably connected to said third arm and the other end adjacent said curved slot of said member;

a pin fixed to said other end of said link and extending through said slot of said member for imparting oscillation to said differential feed shaft in an amount determined by the position of said pin in said curved slot;

means for moving said pin to a selected position in said curved slot to regulate the oscillation of said differential feed shaft;

an auxiliary feed bar carried by said main feed bar for rising and falling motion therewith but for independent longitudinal motion with respect thereto;

a second feed dog carried by an end of said auxiliary feed bar in front of said first feed dog;

a crank supported on said differential feed shaft; and, means connecting said crank to said auxiliary feed bar for converting the oscillations of said differential feed shaft to longitudinal feeding motion of said second feed dog.

2. A differential feed system as claimed in claim 1 wherein said moving means further comprises:

a second link having one end connected to said pin;

a first lever having one end pivoted on said frame and the other end connected to the other end of said second link;

a third link having one end pivotably connected substantially medially of said first lever;

a second lever having one end connected to the other end of said third link, pivotably carried by said sewing machine frame substantially medially thereof, and the other end extending externally of said sewing machine frame; and, means for retaining said other end of said second lever in a selected regulating position.

3. A differential feed system as claimed in claim 2 further comprising:

a fourth link having a first end pivotally connected to said dial and second end having a slot embracing a pivot pin on said second lever, whereby motion of said other end of said second lever is possible in a limited range determined by the length of said slot in the connection of said fourth link to said second lever and motion of said second lever beyond said limited range will also shift said dial for adjustment of said feed regulator in the same increasing or decreasing feed direction as said second lever.

4. A differential feed system for feeding a work material in a longitudinal direction in a sewing machine having a frame, said feed system comprising:

a main feed system including a first feed dog;

an auxiliary feed system deriving oscillating motion from said main feed system and including a second feed dog;

means for supporting said first and said second feed dog for combined rising and falling motion and for independent longitudinal motion;

said main feed system further including means for regulating the longitudinal motion of said first feed dog;

said auxiliary feed system further including means for controlling the oscillating motion derived from said main feed system so as to control the longitudinal motion of said second feed dog; and, means responsive to motion of said controlling means beyond a limited range for repositioning said regulating means to avoid interference between said main feed system, said auxiliary feed system and said frame.

* * * * *